United States Patent [19]

Faurel

[11] Patent Number: 5,012,794

[45] Date of Patent: May 7, 1991

[54] OVEN CLOSURE DEVICE

[75] Inventor: Jacques Faurel, Annecy, France

[73] Assignee: Societe Cooperative de Production Bourgeois, Faverges, France

[21] Appl. No.: 438,625

[22] Filed: Nov. 17, 1989

[30] Foreign Application Priority Data

Nov. 17, 1988 [FR] France ..... 88 15209

[51] Int. Cl.[5] ..... F24C 15/04

[52] U.S. Cl. ..... 126/197; 126/191; 292/106; 292/113

[58] Field of Search ..... 126/197, 191; 292/106, 292/109, 113, DIG. 69

[56] References Cited

U.S. PATENT DOCUMENTS 3,831,580 8/1974 McLean .
4,163,443 8/1979 Peterson .
4,351,288 9/1982 Gasloli ..... 126/197
4,554,907 11/1985 Overley et al. .

FOREIGN PATENT DOCUMENTS 1906621 9/1970 Fed. Rep. of Germany .

*Primary Examiner*—Larry Jones
*Attorney, Agent, or Firm*—Ratner & Prestia

[57] ABSTRACT

A closure for ovens is divulged, comprising a hook mounted for sliding in the oven body between a locked position, in which no lateral movement of the hook is possible and an engaged position in which the hook may move laterally against the retaining force of a spring for letting the door catch pass. A lever retains the hook in the locked position and must be actuated for unlocking and opening of the door.

11 Claims, 4 Drawing Sheets

OVEN CLOSURE DEVICE

BACKGROUND OF THE INVENTION

The present invention relates to enclosures, such as ovens, having an opening closable by means of a hinged door.

In known ovens, the door comprises a rigid frame hinged along one of its sides to the edge of the oven enclosure. A peripheral seal provides sealing between the inner face of the door and the enclosure in the closed position. The door is generally retained by a hook mounted in the oven body and cooperating with a catch mounted in the door for retaining the catch and the door in the locked position and releasing the catch and the door for opening the oven. The hook is generally mounted for rotation about a pin fixed to the oven body, between an axial position in which it retains the catch and an escape position in which it releases the catch. The hook comprises a retainer housing in which the catch is engaged in the locked position when the hook is in an axial position. A retainer ramp limits the retainer housing and forms a bearing surface for retaining the catch in the locked position and preventing opening of the door. A tripping ramp may be provided on the front face of the hook for causing the hook to pivot and escape from its axial position when the catch is introduced for closing the door.

In known oven closure devices, the door may then assume two positions: a position in which it is not retained by the hook and a locked position in which it is held firmly in the hook and can only be opened by manipulating the hook itself. The result is that, when manipulating the hook for unlocking the door, the latter opens suddenly and lets the gases and vapors contained in the oven enclosure escape suddenly.

Such a sudden escape of the gas vapors during opening of the door is an important drawback in modern ovens and, in particular, in steam ovens comprising an internal steam generator for cooking foods.

Another disadvantage of known ovens is that closure thereof, to attain the locked position, is reached in a short travel corresponding to the door catch sliding over the tripping ramp of the hook. Such short travel makes sealed closure delicate, which sealed closure is necessary in steam ovens.

SUMMARY OF THE INVENTION

The object of the present invention is in particular to avoid the drawbacks of known closure devices by providing an new engagement structure defining three distinct positions, namely an open door position in which the door is not retained by the engagement means, an engaged position in which the door is simply retained and held by the engagement means, the door then being able to be opened by a simple pull, and a locked position in which the door is firmly retained by the engagement means and can only be opened by actuating said engagement means; in the locked position, the door is hermetically closed and when the engagement means are unlocked, the door is partially released and is in the engaged position in which it is retained. Thus, opening and closure take place in two stages, passing necessarily through the intermediate engaged position.

According to another object of the present invention, passage from the open position to the locked position is achieved by simply pushing the door, first of all to cause it to pass from the open position to the engaged position, then to cause it to pass from the engaged position to the locked position which occurs automatically. Similarly, opening of the door takes place in two stages, first of all by actuating the locking means so as to bring the door into the engaged position, then pulling the door to bring it to the open position.

Another object of the present invention is to promote the operation of steam ovens, by providing a possibility of removing the internal vapor and gases when the door is in the engaged position and by braking and delaying closure of the door by the obligatory passage through the engaged position.

To attain these objects, as well as others, the closure device of the present invention comprises:

a hook mounted for longitudinal sliding on guide means of the oven body, between a retracted locking position in which the guide means prevent the hook from pivoting and an advanced engagement position in which the guide means allow the hook to pivot about a fixed pin, away from its axial position;

first resilient means with perpendicular actuation urging the hook to return it to its axial position;

a mobile locking stop, urged by actuating means, retains the hook in the retracted locking position and releases it under the action of the actuating means. Thus, in the locked position, the hook firmly retains the door which can only be opened by actuating the means actuating the mobile locking stop. By such actuation, the door and the hook come into the engaged position. From this position, the door may be opened by urging the hook, by simple rotation about its fixed pin.

In another possibility, the hook retainer ramp is slanted so that, in the engaged position, the door may be opened by a pull exerted on its handle and overcoming the retention force exerted by the hook and its resilient means on the catch along the retainer ramp.

Similarly, an oblique hook tripping ramp may be provided; such a ramp, associated with second resilient means with locked longitudinal actuation of the hook, urging the hook towards its advanced engagement position, moves the hook away which is urged by the second resilient means with longitudinal actuation by the catch coming to bear on the oblique tripping ramp, for passing from the door open position to the engaged position by simply pushing the door.

In another particular embodiment, the door closure device of the present invention comprises two identical hooks disposed in opposition symmetrically with respect to the longitudinal plane, the hooks being guided by the same guide means, urged by the same locking means and by symmetrical resilient means and cooperating with the same door catch which they retain on each side in the locked position and in the engaged position.

In an advantageous embodiment, an oven having a closure device according to the present invention comprises a double door, with an outer wall with rigid frame hinged along one of its sides to the edge of the enclosure, the door further comprises an inner plate, formed so as to fit to the opening of the enclosure and close it in the closed position; the inner plate is mounted on the outer door wall opposite its inner face, to which it is connected by connection means allowing relative movement of the inner plate with respect to the outer wall, parallel to the movement of the door about its hinges; the connecting means comprise resilient means urging the inner plate away from the door. Thus, during closure of the door, the hook in the engaged position causes braking of the door and slows down application of the inner plate on the opening of the enclosure. Such slowing down is favorable by allowing the seal to position itself correctly with respect to the walls of the enclosure of the oven, thus providing improved sealing.

Preferably, the travel of the hook between its locked position and its engaged position is slightly greater than the travel of the inner plate with respect to the outer, wall of the door. Thus, during unlocking, the door is brought to the engaged position in which the inner plate moves slightly away from the oven body and releases the gases and vapors contained inside the enclosure.

BRIEF DESCRIPTION OF THE DRAWINGS

Other objects, features and advantages of the present invention will be clear from the following description of particular embodiments, with reference to the accompanying figures in which.

DESCRIPTION OF THE PREFERRED EMBODIMENTS

Figure 1:
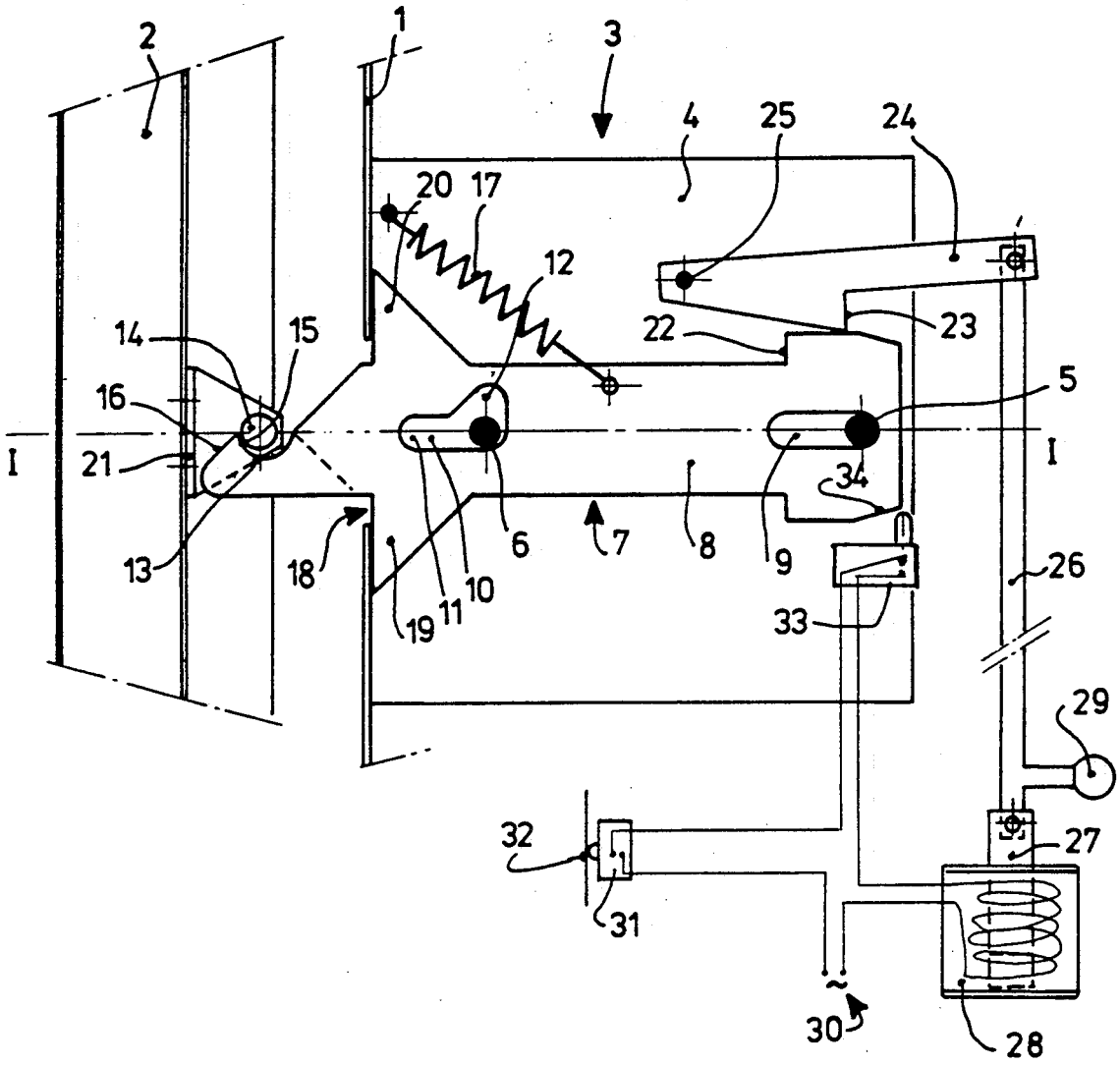
FIG. 1 is a side view of the functional elements of an oven closure device according to the present invention, in the engaged position.

In the embodiment shown in FIG. 1, the oven body 1 can be closed by a hinged door 2, which door 2 is held in the locked position and in the engaged position by a closure assembly 3 fixed to the oven body 1. The closure assembly 3 comprises a fixed plate 4 having two transverse guide rods 5 and 6 perpendicular to plate 4 and parallel to each other, spaced longitudinally along the longitudinal axis I—I of the device. Hook 7 is formed of a flat body 8 with a rear oblong aperture 9 and a front aperture 10. The rod 5 slides with slight clearance in the rear aperture 9 whereas rod 6 slides with a slight clearance in the front aperture 10. The rear oblong aperture 9 is disposed along the longitudinal axis I—I of the device. The front aperture 10 has the shape of an L, with a longitudinal branch 11 and a perpendicular branch 12 connected to the rear portion of the longitudinal branch 11. The front end of the flat body 8 of the hook projects outside the oven body 1, as shown in the Figure, and comprises an upwardly open retainer housing 13 in which is engaged a catch 14 integral with door 2, when the door is in the locked position and when the hook is in an axial position. The retainer ramp 15 limits the retainer housing 13 and forms a bearing surface for retaining catch 14 in the locked position. A tripping ramp 16 is provided on the front face of the hook for cooperating with catch 14 when the door 2 is pushed to the engaged position. The perpendicular branch 12 of the front aperture 10 is developed in the direction of opening of the hook retainer housing 13. Thus, hook 7 may slide longitudinally along the longitudinal axis I—I between a first position, or engaged position, shown in FIG. 1 in which rods 5 and 6 bear against the rear ends of the rear 9 and front 10 apertures, and a second position or locked position in which rods 5 and 6 bear against the front ends of apertures 9 and 10. In the engaged position shown in FIG. 1, branch 12 allows hook 7 to pivot about rod 5 with a limited angular free movement: in the position shown in FIG. 1, catch 14 is housed in the retainer housing 13. When hook 7 pivots, with rod 6 coming into the bottom of the perpendicular branch 12, the hook releases catch 14 which may then move along the longitudinal axis I—I, since it is no longer retained by the retainer ramp 15.

Hook 7 is urged obliquely, forwards and upwards, by a traction spring 17, one end of which is fixed to the flat hook body 8 and the other end of which is fixed to plate 4. Thus, spring 17 tends to bring hook 7 back to its axial position, along the longitudinal axis I—I when the latter has been moved laterally for passage of the catch 14. Spring 17 also urges hook 7 towards its front engaged position shown in FIG. 1, when it has been moved rearwards to the locked position.

The front part of hook 7 projects from the oven body 1 through an aperture 18 formed in the wall of the oven body. To close this aperture 18, when the door is open or in the engaged position, hook 7 comprises two excrescences 19 and 20, on each side of aperture 7, which come to bear against the front wall of the oven body 1 and thus close aperture 18 in the locked position. The oven door 2 is provided with a thrust plate 21 which, when the door is brought from the engaged position to the locked position, comes to bear on the front end of hook 7 so as to push the hook to the locked position.

The rear part of the flat body 8 of hook 7 comprises an upper shoulder 22 intended to cooperate with a lower tooth 23 forming a mobile stop and carried by a lever 24 in rotation about a fixed pin 25 of plate 4. Lever 24 is urged by an actuating rod 26 whose end comprises a core 27 of an electromagnet 28 and an operating handle 29. The electromagnet 28 is connected electrically in series to a supply source 30 with a first switch 31 actuated by a door opening button 32 accessible to the user and, with a second switch 33 actuated by a ramp 34 of hook 7. The second switch 33 is closed when the hook is in the locked position or retracted position and is open when the hook is in all the other positions, and in particular in the engaged position shown in FIG. 1.

Operation of the device is the following: in the open position, hook 7 is in the position shown in FIG. 1, in which it is brought back by spring 17, parallel to the longitudinal axis I—I. When door 2 is pushed towards the oven body 1, catch 14 comes to bear on the tripping ramp 16 and tends to move the hook 7 laterally away which is retained longitudinally by the thrust exerted by spring 17, allowing catch 14 to pass and be inserted in the retainer housing 13. The device is then in the engaged position, shown in FIG. 1. With further pushing of door 2, the thrust plate 21 pushes hook 7 back rearwards against the retaining force of spring 17 and brings it into a locked position in which rods 5 and 6 are in abutment in the front bottom of apertures 9 and 10. In this position, lever 24 drops under the effect of gravity and tooth 23 comes to bear in front of shoulder 22 and retains hook 7. In this position, rod 6 is inserted in the narrow portion of the front aperture 10, namely its longitudinal branch 11, and prevents any lateral pivoting of hook 7. The device is then in the locked position, preventing catch 14 from escaping and door 2 from opening.

From the locked position, opening of the door requires the first switch 31 to be actuated which feeds the electromagnet 28 and raises lever 24 through rod 26. Tooth 23 then lets shoulder 22 escape and hook 7 returns to the engaged position under the action of spring 17. The door 2 is then retained in this engaged position shown in FIG. 1, in which position catch 14 is engaged in the retainer housing 13. Complete opening of door 2 requires the door to be pulled, so as to move catch 14 longitudinally which then abuts against the retainer ramp 15, movement of catch 14 causing hook 7 to pivot against the retaining force exerted by spring 17. Hook 7 then comes back to the engaged position.

When in the locked position and should a current failure occur, it is no longer possible to actuate the electromagnet 28. The door may in this case be unlocked by manually actuating the operating handle 29, the procedure for opening the door then being the same, i.e. comprising the intermediate engagement phase.

It has been remarked that oven doors tend in the long run to move slightly with respect to the oven body. The result is then an alignment defect between catch 14 and hook 7, which causes a variation of the force required for passing the catch into and out of the retainer housing 13.

Figure 2:
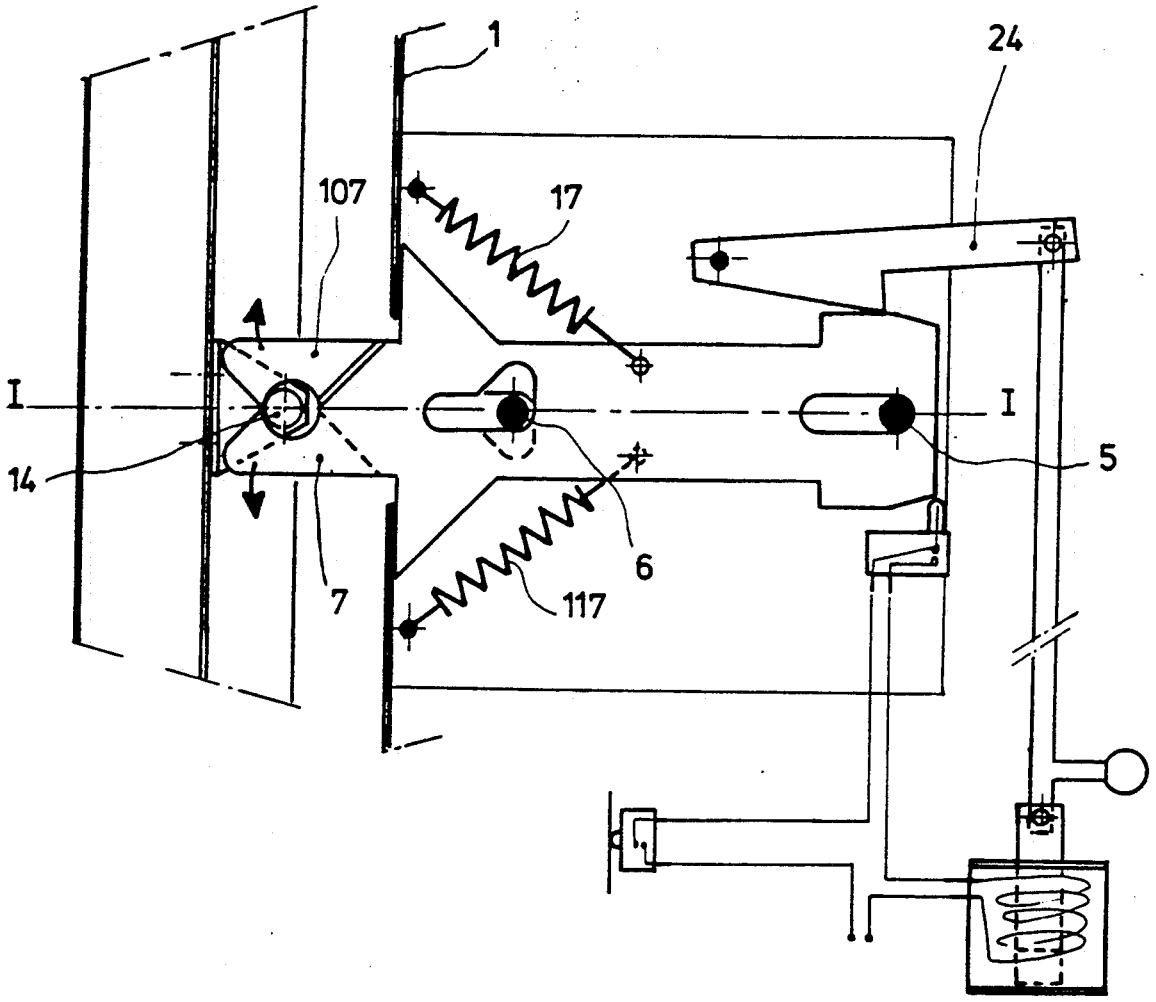
FIG. 2 shows a side view of the closure device in a second embodiment of the present invention, in the engaged position.
Figure 3:
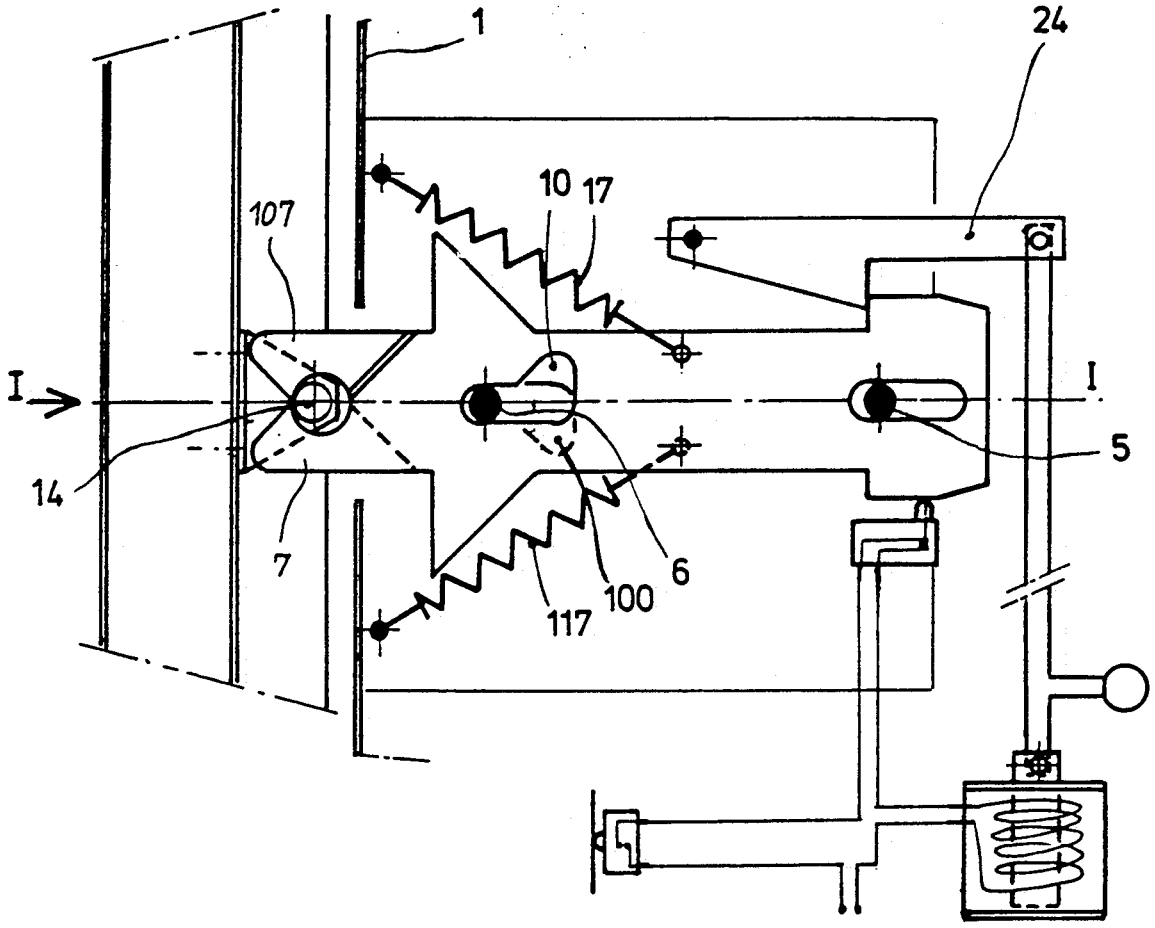
FIG. 3 shows a side view of the closure device of FIG. 2 in the locked position.
Figure 4:
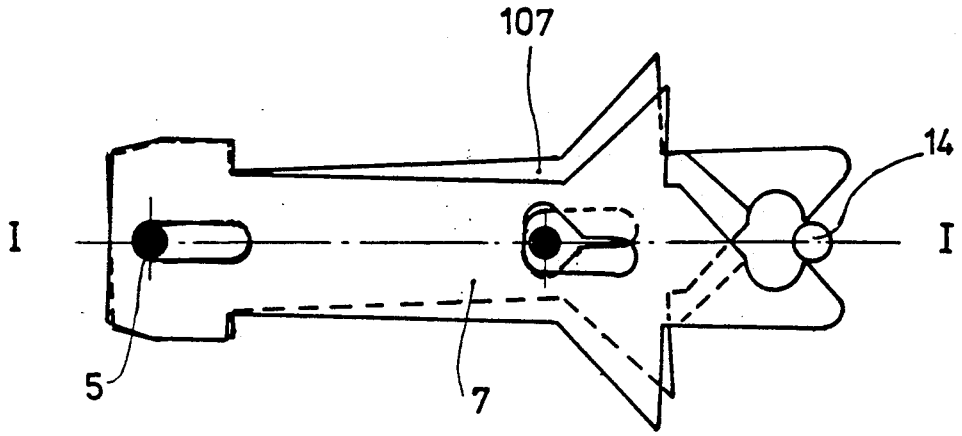
FIG. 4 is a partial view of the elements of the closure device of FIG. 2 in an intermediate position between the open position and the engaged position.

To avoid such variation, and to substantially increase the passage force and so the braking force exerted by the closure means on the door in the engaged position, an embodiment shown in FIGS. 2 to 4 may be used in which the closure device comprises two identical hooks 7 and 107, disposed in opposition symmetrically with respect to the longitudinal plane I—I, as shown in the Figures. The two hooks 7 and 107 are guided by the same rods 5 and 6, retained by the same locking means as lever 24 and cooperating with the same catch 14 which they retain on each side in the locked position shown in FIG. 3 and in the engaged position shown in FIG. 2. Hook 7 is urged by its spring 17 into an oblique position whereas hook 107 is urged by spring 117 disposed in an oblique position symmetrically with respect to spring 17. Operation of the two hooks 7 and 107 is symmetrical with respect to longitudinal plane I—I.

In FIG. 2 can be seen the position of the device comprising two hooks when the door is in the engaged position. Both of the hooks may pivot about rod 5 for engagement or disengagement of catch 14.

In FIG. 3, in the locked position, the two hooks are retracted and retained by lever 24. In this position, the hooks cannot be pivoted by rod 6 which is engaged in the front portion of the corresponding front apertures 10 and 100. In FIG. 4, the relative position of hooks 7 and 107 has been shown during passage of catch 14 between the open position and the engaged position, hooks 7 and 107 being moved away on each side of the longitudinal plane I—I by rotation about rod 5.

Figure 5:
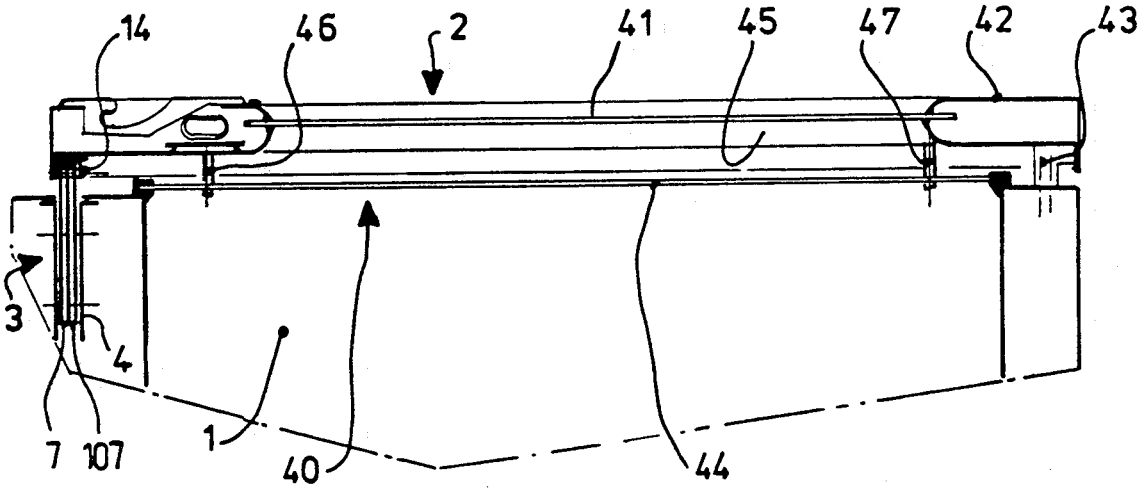
FIG. 5 is a partial sectional view from above of an oven comprising a closure device according to the present invention.

FIG. 5 shows, in a partial sectional view from above, an oven having a closure device in accordance with the present invention. In this embodiment, the oven body 1 has an opening 40 closed by door 2. Door 2 comprises an outer wall 41 defined by a rigid frame 42 hinged to the oven body 1 along a vertical edge 43. The closure device 3 is disposed opposite the vertical articulation edge 43 and hooks 7 and 107 can be seen cooperating with catch 14 integral with a vertical upright of frame 42.

The door further comprises an inner plate 44, formed so as to fit to the opening 40 of the enclosure and close it in the closed position. The inner plate 44 is mounted on the outer wall 41 of the door, facing its inner face 45, to which it is connected by connection means allowing relative movement of the inner plate 44 with respect to the outer door wall 41 parallel to the movement of said door about its hinges 43. The connection is provided by guide rods such as rods 46 and 47 and compression springs pushing the inner plate 44 away from the outer wall 41, so as to cause it to abut on stops of rods 46 and 47, not shown.

On closure of the door, hooks 7 and 107 and springs 17 and 117 which are associated therewith cause braking of the door 2 and slow down the application of the actuating plate 44 against the opening 40 of the enclosure of the oven.

Preferably, the travel of hooks 7 and 107 between their locked position and their engaged position is slightly greater than the travel of the inner plate 44 with respect to the outer wall 41. Thus, during unlocking, the door is brought into the engaged position in which the inner plate 44 moves slightly away from the oven body 1 and releases the gases and vapors contained inside the enclosure.

The present invention is not limited to the embodiments which have been explicitly described, but it includes the different variants and generalizations thereof contained in the field of the following claims.

What is claimed is:

1. A closure device having a longitudinal axis for retaining an oven door in a closed relationship with a front face of an oven body, comprising a hook mounted in the oven body and cooperating with a catch mounted in the door for retaining the catch and the door in the locked position and releasing the catch and the door for opening the oven, the hook comprising a retainer housing in which the catch is engaged in the locked position when the hook is in an axial position along the longitudinal axis, a retainer ramp limiting the retainer housing and forming a bearing surface for retaining the catch in the locked position, a tripping ramp being provided on the front face of the hook for causing the hook to pivot and escape from its axial position during introduction of the catch for closing the door, wherein:

said hook is mounted for longitudinal sliding on guide means of the oven body, between a retracted locking position in which the guide means prevent the hook from pivoting and an advanced engagement position in which said guide means allow the hook to pivot about a fixed pin, away from its axial position;

first resilient means for urging the hook in a direction perpendicular to the longitudinal axis to return it to its axial position;

a mobile locking stop, which moves between first position in which it retains the hook in the retracted locking position, and a second position in which it releases the hook, actuating means for actuating the mobile locking stop towards its first and second positions.

2. The closure device as claimed in claim 1, wherein said hook retainer ramp is slanted so that, in the engaged position, the door may be opened by a pull for overcoming the retaining force exerted by the hook and its resilient means on the catch along the retainer ramp.

3. The closure device as claimed in claim 1, wherein:

the hook tripping ramp is oblique, second resilient means with longitudinal actuation are provided for urging the hook towards its advanced engaged position, so that, during closure of the door for bringing it into the engaged position, the catch bearing against the oblique tripping ramp moves the hook laterally away which is retained longitudinally by second resilient means with longitudinal actuation and is inserted in the retainer housing.

4. The closure device as claimed in claim 3, wherein said first and second resilient means are formed by a single spring disposed in an oblique direction providing a tractive force having simultaneously a longitudinal component for returning the hook to the advanced engaged position and a perpendicular component for returning the hook to the axial position.

5. The closure device as claimed in claim 1, wherein:

said hook comprises a rear oblong aperture with longitudinal axis in which slides a first transverse rod of the oven body forming a rotation pin for the hook, said hook comprises a rear L shaped aperture with a longitudinal branch of the L and a perpendicular branch of the L connected to the rear portion of the longitudinal branch and developing in the opening direction of the retainer housing of the hook, a second transverse rod of the oven body being mounted for sliding in the front aperture, said transverse rods and said apertures forming the means for guiding the hook between the locked position and the engaged position.

6. The closure device as claimed in claim 1, wherein said mobile locking stop is a lever rotating about a fixed pin of the oven body cooperating by means of a lower tooth with an upper shoulder of the hook, and urged by an actuation rod whose end comprises an electromagnet core and an operating handle, said mobile stop tooth engaging on the shoulder of the hook through the effect of gravity when the hook is pushed into the locked position.

7. The closure device as claimed in claim 6, wherein said electromagnet is connected electrically in series with a first switch actuated by a door opening button accessible to the user and with a second switch actuated by a ramp of the hook, said second switch being closed when the hook is in the locked position and being opened when the hook is in the other positions.

8. The closure device as claimed in claim 1, further comprising two identical hooks disposed in opposition symmetrically with respect to the longitudinal plane, guided by the same guide means, urged by the same locking means and by symmetrical resilient means and cooperating with the same door catch which they retain on each side in the locked position and in the engaged position.

9. An oven comprising a closure device such as claimed in claim 1.

10. The oven as claimed in claim 9, wherein:

said door comprises a rigid frame hinged along one of its sides to an edge of the oven enclosure and defining an external wall, said door further comprises an inner plate, formed so as to fit to the opening of the enclosure and close it in the closed position, said inner plate is mounted on the external wall opposite its inner face, to which it is connected by connecting means allowing relative movement of the inner plate with respect to the door parallel to the movement of the door about its hinges, said connecting means comprise resilient means urging the inner plate away from said external wall, so that, during closure of the door, the hook in the engaged position causes braking of the door and slows down application of the inner plate to the opening of the enclosure.

11. The oven as claimed in claim 10, wherein the travel of the hook between its locked position and its engaged position is slightly greater than the travel of the inner plate with respect to the external door wall so that, during unlocking, the door is brought into the engaged position in which said inner plate moves slightly away from the oven body and releases the gases and vapors contained inside the oven.

* * * * *